US008758163B2

(12) United States Patent
Stites

(10) Patent No.: US 8,758,163 B2
(45) Date of Patent: Jun. 24, 2014

(54) IRON TYPE GOLF CLUBS AND GOLF CLUB HEADS HAVING ADJUSTABLE WEIGHTING FEATURES

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 924 days.

(21) Appl. No.: 12/758,553

(22) Filed: Apr. 12, 2010

(65) Prior Publication Data

US 2011/0250985 A1 Oct. 13, 2011

(51) Int. Cl.
*A63B 53/04* (2006.01)
*A63B 53/06* (2006.01)

(52) U.S. Cl.
USPC ..... 473/332; 473/334; 473/349; 473/350

(58) Field of Classification Search
CPC ..... A63B 53/047; A63B 53/06; A63B 2053/0491; A63B 53/0475; A63B 59/0092
USPC ..... 473/324–350, 287–292
See application file for complete search history.

(56) References Cited

U.S. PATENT DOCUMENTS

| | | | | |
|---|---|---|---|---|
| 3,955,820 | A | 5/1976 | Cochran et al. | |
| 4,928,972 | A * | 5/1990 | Nakanishi et al. | 473/332 |
| 5,297,794 | A | 3/1994 | Lu | |
| 5,409,229 | A | 4/1995 | Schmidt et al. | |
| 5,655,976 | A | 8/1997 | Rife | |
| 5,833,551 | A | 11/1998 | Vincent et al. | |
| 6,015,354 | A * | 1/2000 | Ahn et al. | 473/256 |
| 6,080,069 | A | 6/2000 | Long | |
| 6,409,612 | B1 | 6/2002 | Evans et al. | |
| 6,592,468 | B2 | 7/2003 | Vincent et al. | |
| 6,688,989 | B2 * | 2/2004 | Best | 473/332 |
| 6,719,641 | B2 | 4/2004 | Dabbs et al. | |
| 6,811,496 | B2 | 11/2004 | Wahl et al. | |
| 7,083,530 | B2 | 8/2006 | Wahl et al. | |
| 7,207,900 | B2 | 4/2007 | Nicolette et al. | |
| 8,317,635 | B2 * | 11/2012 | Gilbert et al. | 473/335 |
| 2003/0013545 | A1 * | 1/2003 | Vincent et al. | 473/332 |
| 2005/0026716 | A1 | 2/2005 | Wahl | |
| 2005/0037864 | A1 | 2/2005 | Gilbert et al. | |
| 2006/0240908 | A1 * | 10/2006 | Adams et al. | 473/334 |
| 2007/0155534 | A1 | 7/2007 | Tsai et al. | |
| 2007/0207878 | A1 | 9/2007 | Tavares et al. | |
| 2008/0318706 | A1 | 12/2008 | Larson | |
| 2009/0062032 | A1 | 3/2009 | Boyd et al. | |

FOREIGN PATENT DOCUMENTS

| | | |
|---|---|---|
| GB | 2393914 A | 4/2004 |

OTHER PUBLICATIONS

International Search Report and Written Opinion issued on Aug. 11, 2011 in corresponding PCT Application No. PCT/US2011/031151 filed on Apr. 5, 2011.
International Preliminary Report on Patentability dated Oct. 16, 2012 from PCT/US2011/031151.

* cited by examiner

*Primary Examiner* — Sebastiano Passaniti
(74) *Attorney, Agent, or Firm* — Banner & Witcoff, Ltd.

(57) ABSTRACT

Iron golf club heads and clubs include a body having a ball striking face, a rear face opposite the ball striking face and a sole portion positioned between the ball striking face and the rear face. The rear face has an opening in communication with a slot positioned in the body. A weight element is positioned in the slot through the opening. The weight element has at least one aperture wherein the center of gravity is shifted when the weight element is positioned in the slot.

60 Claims, 9 Drawing Sheets

FIG. 7b
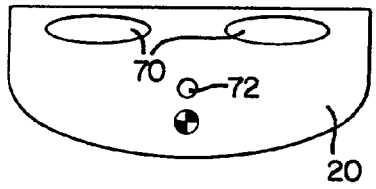
FIG. 7a
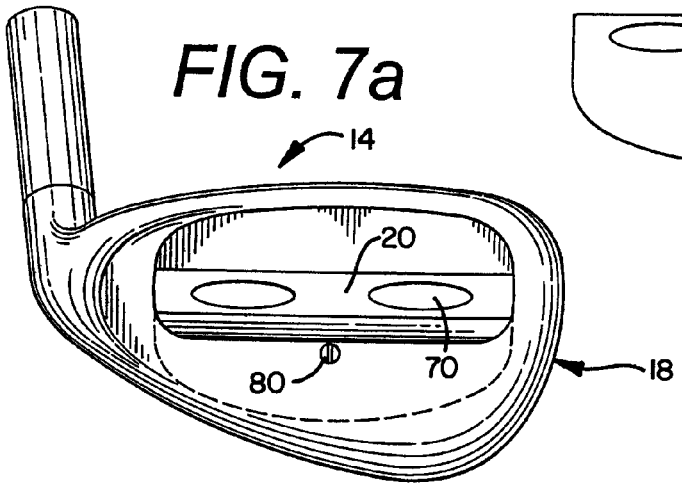
FIG. 8b
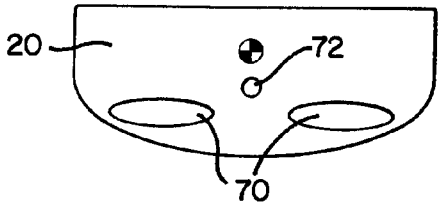
FIG. 8a
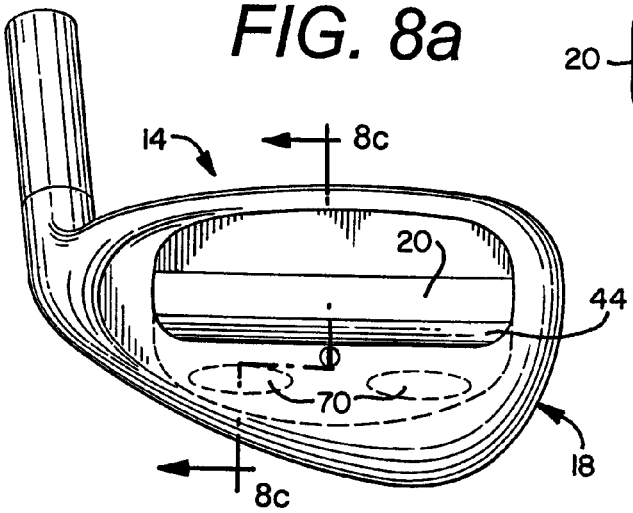
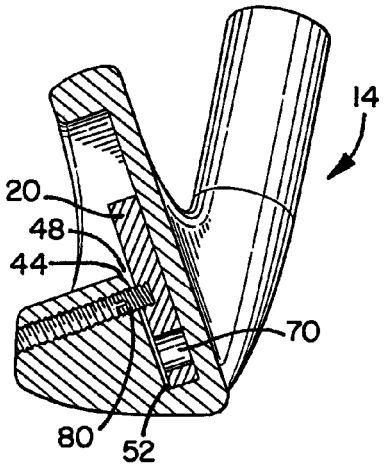
FIG. 8c FIG. 13a
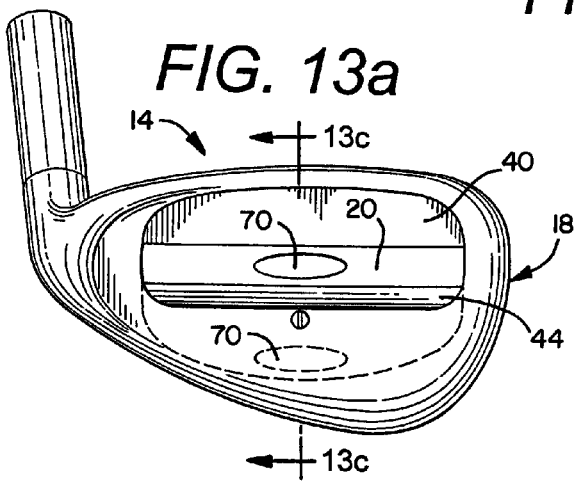
FIG. 13c
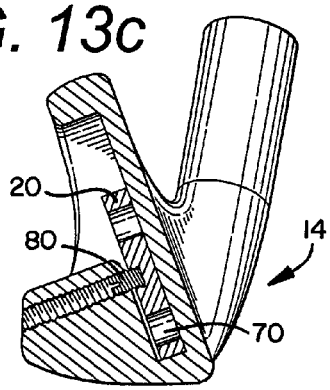
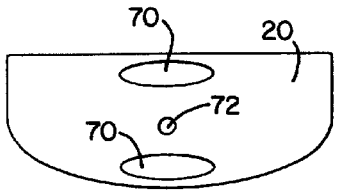
FIG. 13b
FIG. 14c
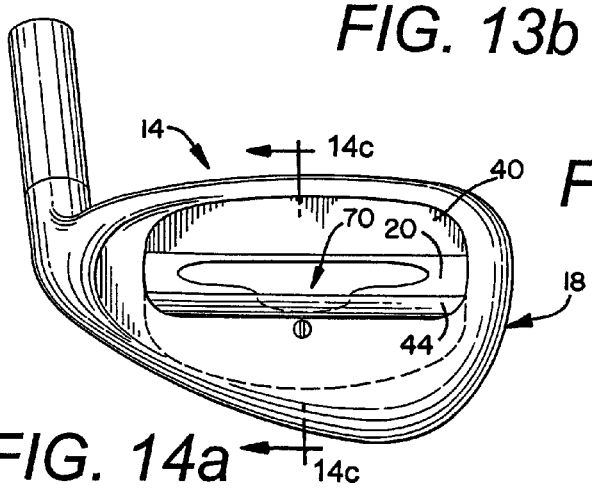
FIG. 14a
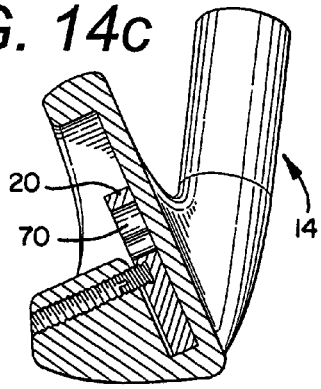
FIG. 14b
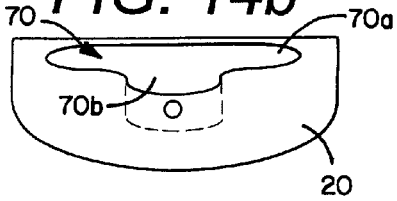
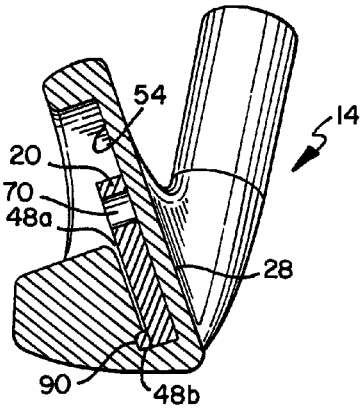
FIG. 15

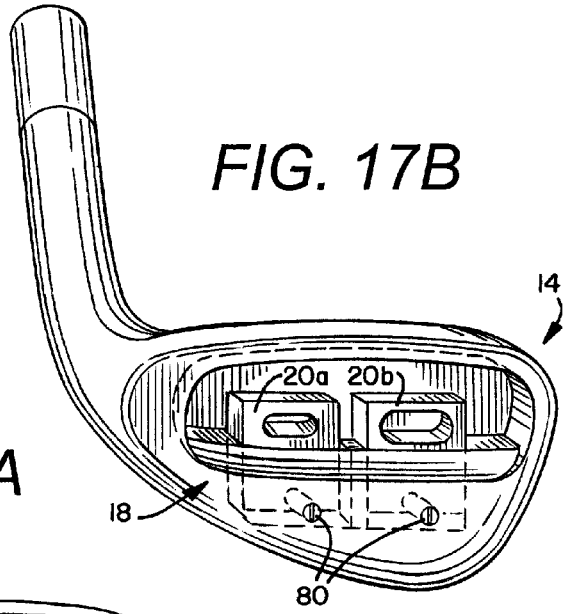
FIG. 17B
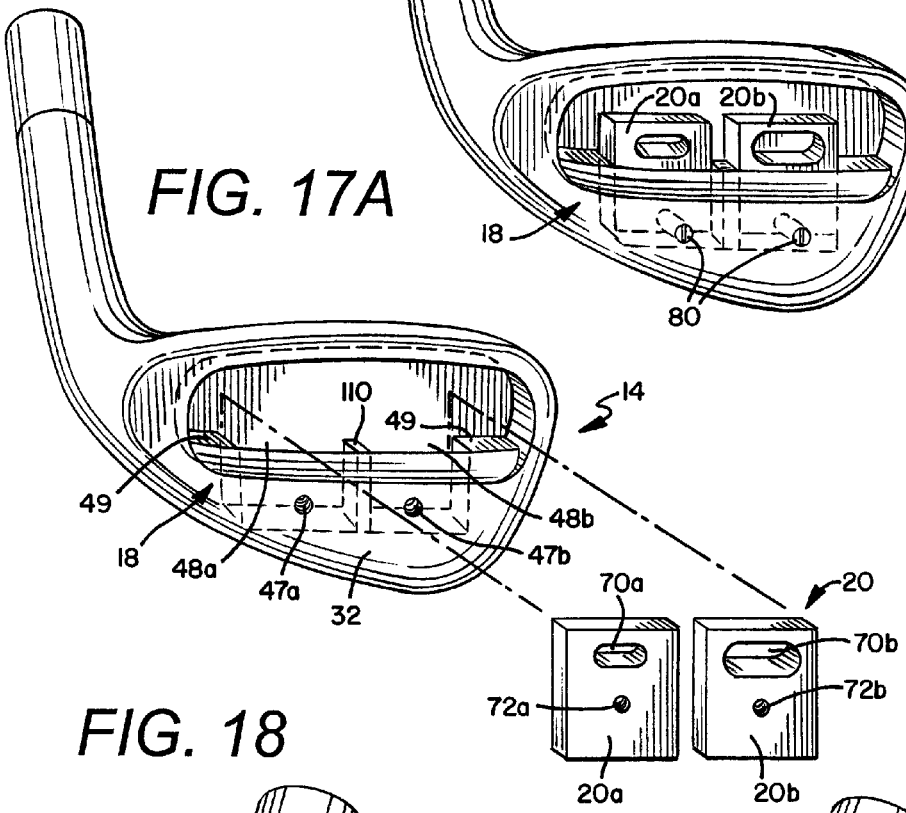
FIG. 17A
FIG. 18
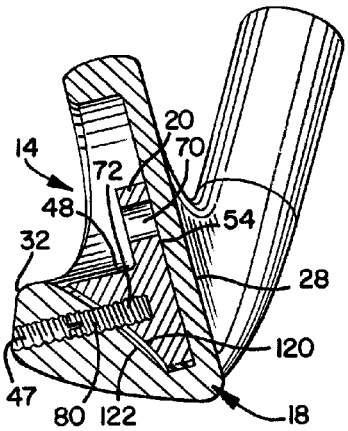
FIG. 19
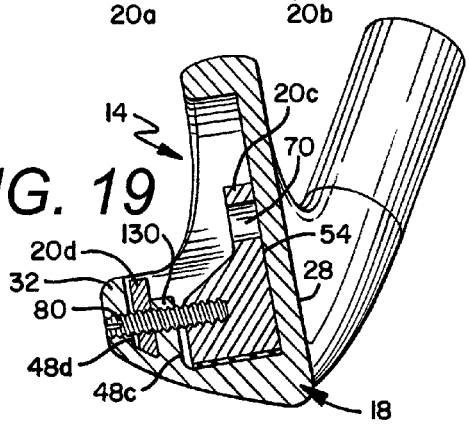

IRON TYPE GOLF CLUBS AND GOLF CLUB HEADS HAVING ADJUSTABLE WEIGHTING FEATURES

FIELD OF THE INVENTION

The present invention relates to golf clubs and golf club heads. Particular example aspects of this invention relate to iron type golf clubs and iron type golf club heads having an insert member or weight element for adjustable weighting features.

BACKGROUND

Various golf club heads have been designed to improve a golfer's accuracy by assisting the golfer in squaring the club head face at impact with a golf ball. A number of golf club heads reposition the weight of the golf club head in order to alter the location of the club head's center of gravity. The location of the center of gravity of the golf club head is one factor that determines whether a golf ball is propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices". Similarly, when the center of gravity is spaced above or below the point of engagement, the flight of the golf ball may exhibit more boring or climbing trajectories, respectively. Accordingly, for any particular golfer, altering the center of gravity of the golf club can assist in certain shot-making capabilities.

Golf club heads, such as perimeter weighted and cavity back club heads, assist the golfer by locating much of the weight of the golf club head around the golf club head perimeter. Generally, these golf club heads are more forgiving than non-cavity back golf club heads (e.g., traditional "blade" type irons) thereby allowing a golf ball to be struck somewhat off center or mis-hit, while still providing relatively good distance and accuracy. Perimeter weighted and cavity back club heads have helped the average golfer reduce the impact of mis-hits and improve scoring. Such features can be utilized in conjunction with adjustable weighting features.

Accordingly, while golf club heads having adjustable weighting features according to the prior art provide a number of advantageous features, they nevertheless have certain limitations. The present invention seeks to overcome certain of these limitations and other drawbacks of the prior art, and to provide new features not heretofore available.

SUMMARY OF THE INVENTION

Iron type golf club heads according to at least some example aspects of this invention include: a body having a ball striking face, a rear face opposite the ball striking face and a sole portion positioned between the ball striking face and the rear face. The rear face has an opening in communication with a slot positioned in the body. A weight element is positioned in the slot through the opening. The weight element may be made from suitable materials and/or positioned within the club head cavity so as to affect the center of gravity characteristics of the golf club head so as to enable customization and/or tuning of the overall weight of the club head (e.g., for swing weighting purposes, for ball flight control purposes (e.g., to draw bias the club, to fade bias the club, to help compensate for swing flaws that produce a hook, to help compensate for swing flaws that produce a slice, etc.)). The weight element may also dampen vibrations and/or affect the sound produced when a ball (or other object) is struck.

According to another aspect of the invention, the weight element has at least one aperture therethrough to define a removed weight portion. The aperture may comprise a plurality of apertures. The weight element may be formed from a variety of materials and is made from stainless steel in one exemplary embodiment.

According to a further aspect of the invention, the slot is defined between an inner surface of the ball striking face and an inner surface of the rear face. The slot may extend from the sole portion to proximate a mid portion of the rear face. The slot may also extend from the sole portion to a location under a mid portion of the rear face. The weight element extends upwards past the opening. The slot may further extend to a top portion of the sole portion. In other aspects, the slot extends to proximate a mid portion of the rear face to define a slot opening, the opening in the rear face having a lower edge generally coinciding with a first end of the slot, and wherein the opening has an upper edge, wherein the weight element has a top edge positioned between the upper edge and the lower edge when the weight element is positioned in the slot. When the weight element has an aperture, the aperture is positioned between the upper edge and the lower edge when the weight element is positioned in the slot.

According to a further aspect of the invention, the rear surface has a bore therethrough and in communication with the slot. A fastener is positioned in the bore and engages the weight element to secure the weight element in the slot. In a further aspect, the weight element has a bore aligned with the bore of the rear surface, and the fastener is positioned in the bore of the rear surface and the bore of the weight element to secure the weight element in the slot.

According to another aspect of the invention, the weight element is forced against an inner surface of the ball striking face. In an exemplary embodiment, the force applied to the weight element is generally perpendicular to the inner surface. In the exemplary embodiment wherein the rear surface has the bore and is in communication with the slot, the fastener is positioned in the bore and forces the weight element against an inner surface of the ball striking face to secure the weight element in the slot. The force applied to the weight element is generally perpendicular to the inner surface. In an alternative arrangement, the force can be applied towards the inner surface of the ball striking face and have a component towards the sole of the club head body.

According to a yet another aspect of the invention, the weight element has a shock absorbent member attached thereto. The weight element has a first side edge and a second side edge and a bottom edge, and the shock absorbent member is positioned on the first side edge, the second side edge and the bottom edge. The shock absorbent member is a polymeric material in one exemplary embodiment.

According to further aspects of the invention, the weight element may have apertures at various locations on the weight element. For example, the weight element has an aperture proximate a bottom edge of the weight element. The weight element may have an aperture proximate a top edge of the weight element. In other embodiments, the weight element has an aperture proximate a top edge and a side edge of the weight element, wherein the weight element is positioned in the slot wherein the aperture is positioned proximate a heel portion of the body. The weight element can also be positioned in the slot wherein the aperture is positioned proximate a toe portion of the body. In another embodiment, the weight element has an aperture proximate a bottom edge and a side edge of the weight element, wherein the weight element is positioned in the slot wherein the aperture is positioned proximate a toe portion of the body. The weight element may also be positioned in the slot wherein the aperture is positioned proximate a heel portion of the body. In other embodiments, the weight element has a first aperture positioned proximate a top edge of the weight element and at a central location of the weight element, and wherein the weight element further has a second aperture positioned proximate a bottom edge of the weight element and at a central location of the weight element. In yet another embodiment, the weight element has an aperture having an upper horizontal section and a lower vertical section depending from the horizontal section. It is understood that weight elements having apertures at various locations can be utilized. The weight elements can also have shapes such as tapered portions that extend towards a rear end of the club head body.

In another aspect of the invention, the slot has a first section and a second section generally transverse to the first section. The weight element has a lip received by the second section when the weight element is positioned in the slot.

In another aspect of the invention, the slot and weight elements may be comprised of multiple slots and elements. The weight elements may have differently sized apertures for increased customization capabilities of the golf club. The club head may also have a multiple slots separated by an internal wall. Each slot may receive a separate weight element. In another embodiment, one of the slots may receive a weight element while one of the slots may remain empty.

Additional aspects of this invention relate to iron type golf clubs and to methods for producing iron golf club heads and golf clubs including club heads with insert members of the types described above.

BRIEF DESCRIPTION OF THE DRAWINGS

The present invention is illustrated by way of example and not limited in the accompanying figures, in which like reference numerals indicate similar elements throughout, and in which:

FIG. 7*a* is a rear elevation view of the golf club head shown in FIGS. 2-6*a;*

FIG. 7*b* is a rear elevation view of the weight element shown in FIG. 5*a;*

FIG. 8*a* is a rear elevation view of an alternative embodiment of a golf club head in accordance with the present invention;

FIG. 8*b* is a rear elevation view of the weight element shown in FIG. 8*a;*

FIG. 8*c* is cross-sectional view of the golf club head taken along lines 8*c*-8*c* shown in FIG. 8*a* and showing the weight element in a secured position;

FIG. 13*a* is a rear elevation view of an alternative embodiment of a golf club head in accordance with the present invention;

FIG. 13*b* is a rear elevation view of the weight element shown in FIG. 13*a;*

FIG. 13*c* is cross-sectional view of the golf club head taken along lines 13*c*-13*c* shown in FIG. 13*a* and showing the weight element in a secured position;

FIG. 14*a* is a rear elevation view of an alternative embodiment of a golf club head in accordance with the present invention;

FIG. 14*b* is a rear elevation view of the weight element shown in FIG. 14*a;*

FIG. 14*c* is cross-sectional view of the golf club head taken along lines 14*c*-14*c* shown in FIG. 14*a* and showing the weight element in a secured position;

FIG. 15 shows a cross-sectional view of an alternative embodiment of a golf club head in accordance with the present invention;

FIG. 17*a* shows a rear perspective view of an alternative embodiment of a golf club head in accordance with the present invention;

FIG. 17*b* shows a rear perspective view of the golf club head of FIG. 17*a;*

FIG. 18 shows a cross-sectional view of an alternative embodiment of the golf club head in accordance with the present invention and showing the weight element in a secured position; and FIG. 19 shows a cross-sectional view of an alternative embodiment of the golf club head in accordance with the present invention and showing weight elements in separate slots and in a secured position.

DETAILED DESCRIPTION

Figure 1:
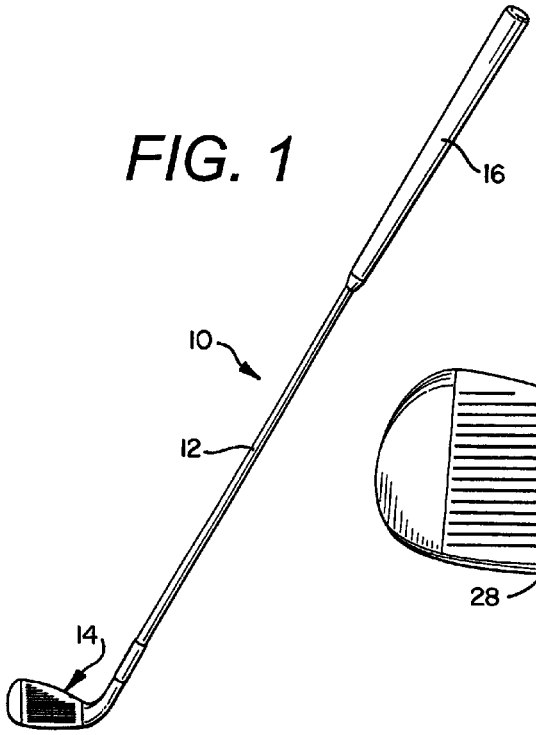
FIG. 1 is a front perspective view of an example golf club having an example golf club head in accordance with the present invention.

The following description and the accompanying figures disclose features of golf club heads and golf clubs in accordance with the present invention (e.g., iron or iron-type hybrid golf clubs and golf club heads).

I. GENERAL DESCRIPTION OF EXAMPLE GOLF CLUB HEADS, GOLF CLUBS, AND METHODS IN ACCORDANCE WITH THIS INVENTION

Aspects of this invention generally relate to iron type golf club heads and golf clubs including such club heads (e.g., iron type hybrid clubs, driving irons, 0-9 irons, pitching wedges, sand wedges, gap wedges, loft wedges, etc.), although aspects of this invention may be extended for use in other club head structures, such as putters, drivers, woods, etc. Iron type golf club heads according to at least some example aspects of this invention may include: a body having a ball striking face, a rear face opposite the ball striking face and a sole portion positioned between the ball striking face and the rear face. The rear face has an opening in communication with a slot positioned in the body. A weight element is positioned in the slot through the opening. The weight element may be made from suitable materials and/or positioned within the club head cavity so as to affect the center of gravity characteristics of the golf club head so as to enable customization and/or tuning of the overall weight of the club head (e.g., for swing weighting purposes, for ball flight control purposes (e.g., to draw bias the club, to fade bias the club, to help compensate for swing flaws that produce a hook, to help compensate for swing flaws that produce a slice, etc.)). The weight element may also dampen vibrations and/or affect the sound produced when a ball (or other object) is struck. The golf club head may have a generally perimeter weighted and/or cavity back type structure as is known or used in the art (e.g., with a sole portion extending rearwardly to form a portion of the perimeter weighting member structure).

While the weight element may be made from a variety of materials in a variety of different constructions, in at least some example structures according to this invention, it will be made of suitable materials and/or positioned within the club head slot to shift the center of the golf club head. The weight element may also assist to dampen vibrations and/or alter the sound produced when a ball (or other object) is struck and/or so as to enable customization and tuning of the overall weight of the club head (e.g., for swing weighting purposes, for ball flight control purposes (e.g., to draw bias the club, to fade bias the club, to help compensate for swing flaws that produce a hook, to help compensate for swing flaws that produce a slice, etc.), etc.).

Additional aspects of this invention relate to iron type golf clubs (e.g., iron type hybrid clubs, driving irons, 0-9 irons, pitching wedges, sand wedges, gap wedges, loft wedges, etc.). Such clubs may include, for example: (a) iron golf club heads of the types described above; (b) a shaft member engaged with the golf club head (e.g., at a hosel or other head connection area); and/or (c) a grip member engaged with the shaft member. The club head and its weight element may have any one or more of the various characteristics or properties described above. The clubs may have additional features and characteristics as well, including features and/or characteristics of conventional club heads as are known and used in the art.

Still additional aspects of this invention relate to methods for producing iron golf club heads, e.g., of the types described above. Such methods may include: (a) providing a club head body (e.g., by manufacturing it, by constructing it, by obtaining it from a third party source, etc.) including a ball striking face, a rear surface opposite the ball striking face, and a sole portion extending rearward from the ball striking face, wherein the rear face has a rear opening in communication with a slot positioned in the body; (b) providing a weight element that includes an aperture therethrough; (c) inserting the weight element in the slot through the opening; and (d) securing the weight element to the golf club head body. The club head and its weight element may be formed to have any one or more of the various characteristics or properties described above.

Additionally, if desired, methods in accordance with at least some examples of this invention may include one or more of the following additional steps: (a) removing the weight element from the slot; (b) inserting a second weight element into the slot wherein the second weight element has a different center of gravity from the first weight element and/or (c) securing the second weight element in the club head body.

Methods of producing iron type golf clubs in accordance with at least some example aspects of this invention may include: (a) providing a golf club head of the types described above (e.g., including any or all of the various structures, features, and/or arrangements described above, such as a weight element, etc.), e.g., by manufacturing or otherwise making the golf club head, by obtaining it from a third party source, etc.; (b) engaging a shaft member with the golf club head; and/or (c) engaging a grip member with the shaft member. The club head may allow manufacturers, club fitters, users, or others to customize the weighting, weight locations, and/or other features of the club head, e.g., as described above and as will be described in more detail below.

Given the general description of aspects of the invention provided above, more detailed descriptions of various specific examples of golf clubs and golf club head structures according to the invention are provided below.

II. DETAILED DESCRIPTION OF EXAMPLE GOLF CLUB HEADS, GOLF CLUB STRUCTURES, AND METHODS ACCORDING TO THE INVENTION

The following discussion and accompanying figures describe various golf clubs and golf club head structures in accordance with examples of the present invention.

FIG. 1 shows an exemplary embodiment of an iron type golf club of the present invention, generally designated with the reference numeral 10. The iron type golf club 10 generally includes a shaft 12 attached to a golf club head 14.

As further shown in FIG. 1, the shaft 12 of the golf club 10 is an elongated member and also has a grip element 16 generally at a distal end of the shaft 12. A proximal end of the shaft 12 is attached or connected to the golf club head 14. The shaft 12 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, via releasable mechanical connections, etc.). The grip element 16 or other handle element 16 is positioned on the shaft 12 to provide a golfer with a slip resistant surface with which to grasp the shaft 12. The grip element 16 may be attached to the shaft 12 in any desired manner, including in conventional manners known and used in the art (e.g., via adhesives or cements, via threads or other mechanical connectors, via fusing techniques, via friction fits, via retaining element structures, etc.). The grip element 16 may be made from any desired materials, including materials that are conventionally known and used in the art.

FIGS. 2-6 further show the golf club head 14. In an exemplary embodiment, the golf club head 14 generally includes a golf club head body 18 and a weight element 20 (FIGS. 5*a*-5*b*) operably connected to the golf club head body 18. The association of the golf club head body 18 and the weight element 20 will be described in greater detail below. It is understood that the golf club head 14 may be representative of any iron or hybrid type golf club head, such as iron type hybrid clubs, driving irons, 0-9 irons, pitching wedges, sand wedges, gap wedges, loft wedges, etc.

Figure 2:
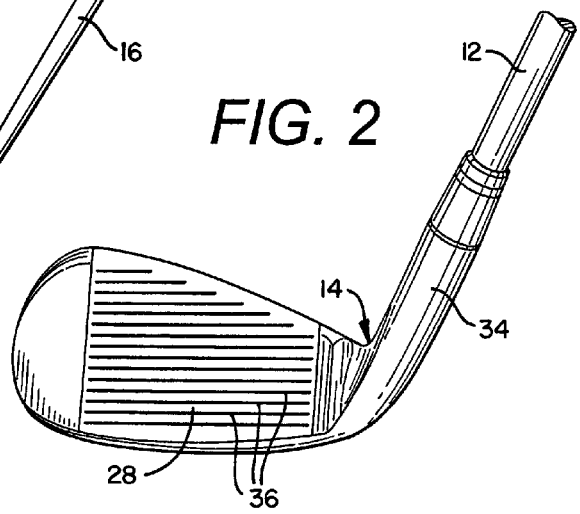
FIG. 2 is a front elevation view of an example golf club head in accordance with the present invention.
Figure 4:
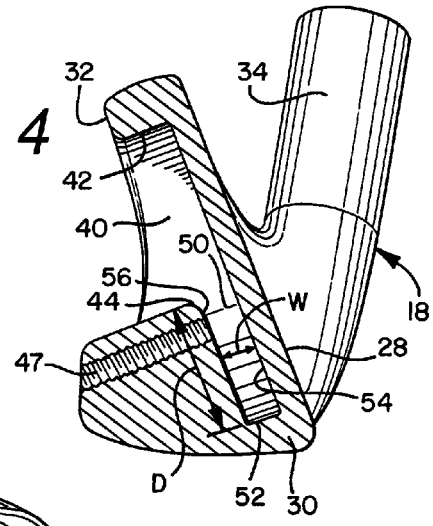
FIG. 4 is a cross-sectional view of the golf club head body taken along lines 4-4 shown in FIG. 3.
Figure 3:
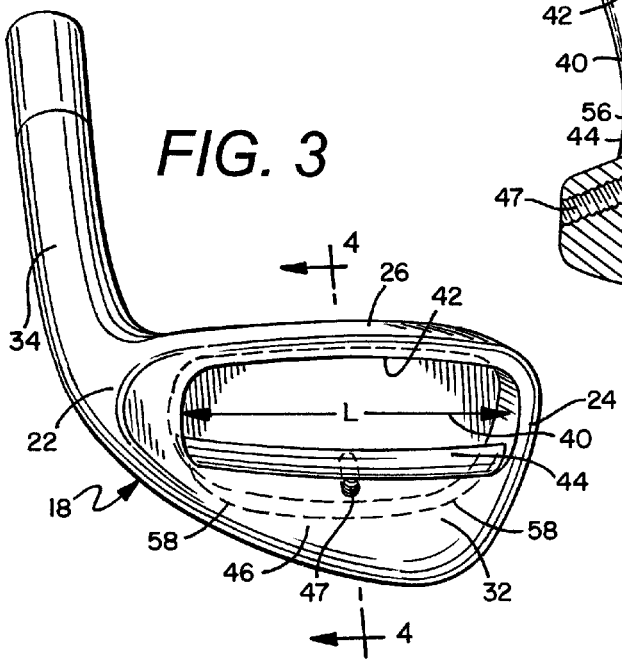
FIG. 3 is a rear perspective view of the golf club head body shown in FIG. 2.

FIGS. 2-4 illustrate the exemplary embodiment of the golf club head 14 in greater detail. As illustrated, the golf club head 14 includes the body member or body 18 that generally includes a heel portion 22, a toe portion 24, a top portion 26, a ball striking face 28, a sole portion 30 and a rear face 32.

The heel portion 22 has a hosel 34 attached to or extending from the heel portion 22 (e.g., as a unitary or integral one piece construction, or as separate connected elements, etc.). The hosel 34 connects the golf club head 14 to the shaft 12 to form the golf club 10. The toe portion 24 is positioned generally opposite the heel portion 22. In addition, the top portion 26 is generally positioned opposite the sole portion 30 positioned generally at a bottom of the body 18. The ball striking face 28 is generally provided between the top portion 26 and the sole portion 30, and between the heel portion 22 and the toe portion 24. The ball striking face 28 provides a contact area for engaging and propelling a golf ball in an intended direction. The striking face 28 may include grooves 36 (e.g., generally horizontal grooves 36 extending across the face 28 in the illustrated example) for the removal of water and/or grass from between the striking face 28 and a golf ball during a ball strike. Any number of grooves, desired groove patterns, and/or groove constructions may be provided (or even no grooves, if desired), including conventional groove patterns and/or constructions, without departing from this invention. The striking face 28 may be integrally formed as a unitary, one-piece construction with the remainder of the club head body member 18, or it may be a separate part attached to the club head body member 18 (e.g., via adhesives or cements; via welding, brazing, soldering, or other fusing techniques; via mechanical connectors; via friction fit; via retaining element structures; etc.).

The body member 18 and/or striking face 28 of the golf club head 14 may be constructed from a wide variety of different materials, including materials conventionally known and used in the art, such as steel, titanium, aluminum, magnesium, tungsten, alloys of these metals, graphite, polymers, fiber-reinforced materials, or composites, or combinations thereof. Also, if desired, the club head 14 may be made from any number of pieces (e.g., having a separate face plate, etc.) and/or by any construction technique, including, for example, casting, forging, welding, and/or other methods known and used in the art.

FIG. 3 illustrates the rear face 32 or back side view of the iron type golf club head 14 in accordance with at least some examples of this invention, and FIG. 4 illustrates a general cross sectional view of the club head 14. As illustrated, in this example structure, the rear of the club head 14 forms a generally perimeter weighted cavity back construction as can be appreciated from the portions of the rear face 32 proximate the top of the body member 18, the bottom of the body member 18, and portions of the body member 18 proximate the heel portion 22 and the toe portion 24. The sole portion 30 of the club head 14 extends around and from the club head face 28 and forms the very bottom of the club head 14, and from there it extends upward to form a lowermost portion of the body member 18 and a portion of the rear face 32 or back side of the club head 14. As further shown in FIG. 3, the rear face 32 has a rear opening 40 extending into the body 18. The opening 40 generally occupies an upper portion of the rear face 32. The opening 40 defines an upper edge 42 positioned proximate the top portion 26 and a lower edge 44 positioned proximate a mid portion of the rear face 32. In certain exemplary embodiments, the lower edge 44 may be positioned just below the mid portion of the rear face 32. The lower edge 44 may have an upwardly inclined portion extending towards the ball striking face 28. The opening 40 further has rounded opposing lateral edges positioned proximate the heel portion 22 and the toe portion 24. Below the rear opening 40, the rear face 32 has a lower planer surface 46 that extends from the lower edge 44 to the sole portion 30. The lower planar surface 46 is generally a solid smooth surface. A threaded opening 47 is positioned through the rear face 32 at the lower planar surface 46. The opening 47 can be formed in a non-threaded configuration if alternate fastening methods are employed as described in greater detail below.

The sole portion 30 of the club head 14 (including the upward extending portion thereof that forms the bottom of the perimeter weight member generally towards a rear end of the body member 18) in this illustrated example forms the bottommost portion of the club head body member 18. As shown in FIGS. 3 and 4, a generally downwardly extending narrow slot 48 extends into the sole portion 30. This downwardly extending slot 48 has a first end 50 proximate the lower edge 44 of the rear opening 40 and a second end 52 proximate a floor in the sole portion 30. The slot 48 is further defined between an inner surface 54 of the ball striking face 28 and an inner surface 56 of the rear face 32. The inner surface 56 of the rear face 32 may be considered to extend into the sole portion 30. As shown in FIG. 3, lateral side edges 58 of the slot 48 are rounded towards the second end 52 of the slot 48. As further shown, the slot 48 extends laterally from generally the heel portion 22 to the toe portion 24. As shown in FIG. 4, the slot 40 extends downwardly and generally follows the angled configuration of the ball striking face 28 in an exemplary embodiment. While the slot 48 is angled similar to the angle of the ball striking face 28, the slot 48 has sufficient depth defined by the confronting inner surfaces 54, 56 to have a generally vertically extending configuration. It is understood that the slot 48 could be configured in more of a vertical configuration if desired. As further shown in FIG. 4, the first end 50 of the slot 48 is proximate the lower edge 44 and is in communication with the rear opening 40. This area may be referred to as a slot opening. In addition, the threaded opening 47 extends through the inner surface 56 of the rear face 32 and is in communication with the slot 48. From this general configuration of the slot 48, the slot 48 extends from the sole portion 30 to a location proximate a mid portion of the rear face 32. In other embodiments, the slot 48 may extend from the sole portion 30 to a location under a mid portion of the rear face 32. It is further understood that the slot 48 can have a segment extending further towards the rear face 32 of the club head 14.

As further illustrated in FIG. 3, the slot 48 has an overall longitudinal length L generally corresponding to the overall longitudinal length L of the rear opening 40 (in the heel-to-toe direction, e.g., the maximum dimension from the heel edge of the rear opening 40 to the toe edge of the rear opening 40). As further shown in FIG. 4, the inner surface 54 of the ball striking face 28 and the inner surface 56 of the rear face 32 are spaced in confronting relation a distance or width W to define this portion of the slot 48. The slot 48 extends from the first end 50 to the second end 52 into the body 18 a distance or depth D. The depth D is of sufficient distance to easily and securely hold and support the weight element 20 as described in greater detail below. The longitudinal length L may be much greater than its overall width dimension W (in the face-to-rear direction, e.g., the maximum dimension from the inner surface 54 of the ball striking face 28 to the inner surface 56 of the rear face 32). In certain exemplary embodiments, the ratio of the maximum overall depth D to the maximum overall width W of the slot 48 can be equal to or greater than 2. In one certain exemplary embodiment, the D/W ratio may be greater than 2.5. In prior art designs, the D/W ratios are typically less than 2 or less than 1.5. Thus, in prior art designs, a depth D is dimensioned more closely to a width W of a weight member 20. In the present invention, the width dimension is substantially lesser than the depth D dimension.

Figure 5A:
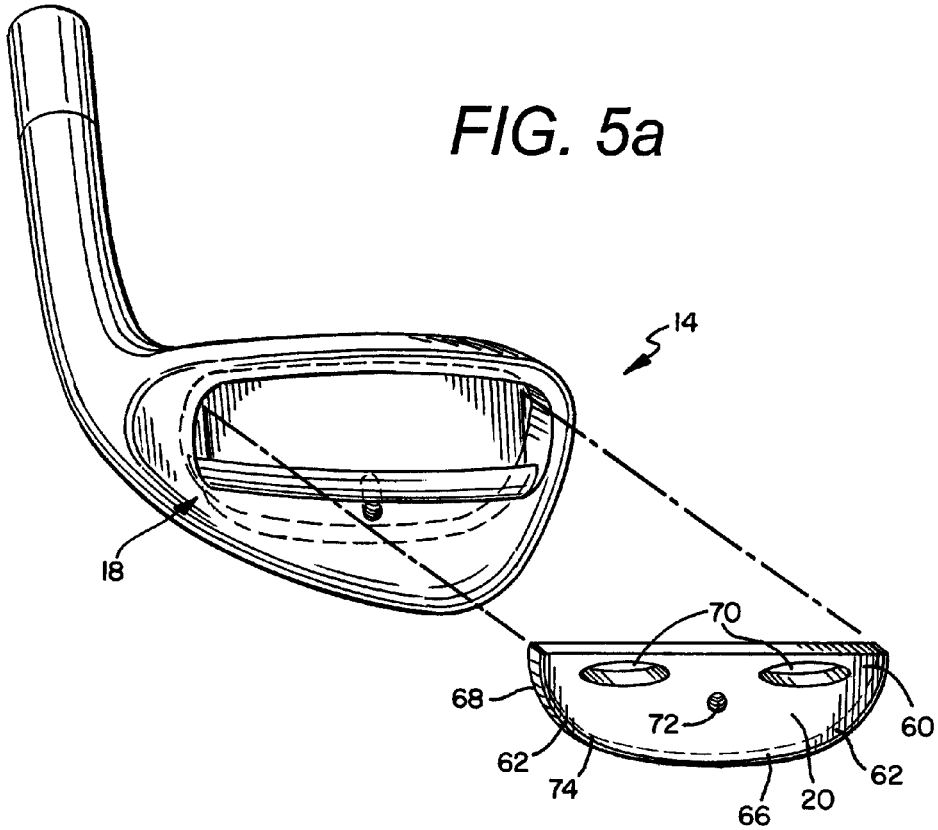
FIG. 5*a* is a rear perspective exploded view of the golf club head of FIG. 2.
Figure 5B:
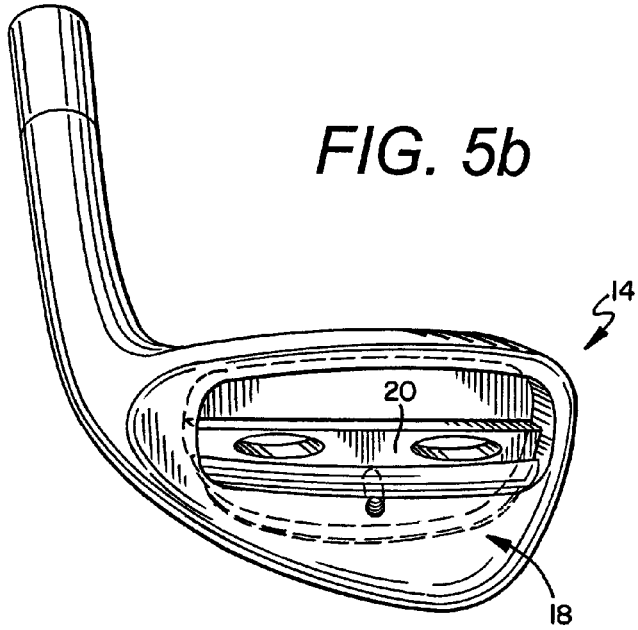
FIG. 5*b* is a rear perspective view of the golf club head of FIG. 2.

As shown in FIGS. 5*a* and 5*b*, the golf club 10 includes the weight member 20, or weight element 20 in accordance with exemplary embodiments of the invention. The weight element 20 may be in the form of a heavy mass weight "chip" that is generally dimensioned to fit within the slot 48 as described in greater detail below. The weight element 20 has a generally straight upper edge 60 and rounded edges 62 that extend to a generally straight bottom edge 64. The weight element 20 further has a first or front surface 66 and a second or rear surface 68 that are generally planar surfaces. The first surface 66 and the second surface 68 of the weight element 20 are spaced to define a thin, narrow width of the weight element 20, generally corresponding to or slightly less than the width W of the slot 48. Similarly, the length of the weight element 20 generally corresponds to or is slightly less than the length L of the slot 48. Thus, as can be appreciated from FIGS. 5*a*-6*b*, the weight element 20 is generally cooperatively dimensioned with the slot 48. It is understood that the slot 48 and weight element 20 can take other cooperatively dimensioned shapes. As explained in greater detail below, the weight element 20 has at least one aperture 70 positioned through the weight element 20 and defined a removed weight portion of the weight element 20. In certain exemplary embodiments, a pair of apertures 70 is included. Locations of the apertures 70 are set to affect overall center of gravity of the weight element 20 and, therefore, the golf club head 14 as will be described in greater detail below. Similarly, the size of the apertures 70 can also vary to control weight etc. The weight element 20 further has a threaded opening 72 positioned through the first surface 66. The threaded opening 72 does not extend completely through the weight element 20 in an exemplary embodiment although the opening 72 could extend completely through if desired. Furthermore, it is understood that the threaded opening 72 could be omitted. Similarly, the apertures 70 could be configured to only extend partially into the weight element 20 if desired.

The weight element 20 can be constructed from a variety of different materials. Material selection can be dependent on the amount of weight desired to be added to the golf club 10. In one exemplary embodiment, the weight element 20 is made from stainless steel. Other materials can also be used including aluminum, tungsten, gold or bronze. The weight element 20 may also be made from materials that are either softer or harder than the materials of the body 18 of the golf club head 14. Such material selections can be made to assist in dampening vibration associated with the golf club head 14. The materials selected can be selected such that the weight element has uniformly distributed weight. As a further possibility, the weight element 20 can be made from weighted polymer from an injection molding process. Weight elements 20 made from lighter materials are also possible. In an exemplary embodiment, the weight element 20 may be approximately 30 grams. The weight element 20 may be selected such that the weight of the weight element 20 is approximately ten percent of the weight of the golf club head 14.

FIGS. 5*a*-7*b* illustrate the formation of the golf club head 14 of the present invention wherein the weight element 20 is operably connected to or otherwise secured to the golf club head body 18. As shown in FIG. 6*a*, the weight element 20 is inserted into the slot 48 through the rear opening 40 as the first end 50 of the slot 48 is in communication with the rear opening 40. It is understood that the height of the weight element 20 and the height of the rear opening 40 (and height of rear wall 32), as well as the width W of the slot 48, are dimensioned such that sufficient clearance is provided for the weight element 20 to be manipulated and slid into the slot 48. As discussed, the weight element 20 is dimensioned to generally correspond to the shape of the slot 48 wherein the weight element 20 substantially fills the slot 48. Thus, the rounded edges 62 and bottom edge 64 of the weight element 20 generally correspond and mate with the rounded edges 58 and second end 52 of the slot 48. As further shown in FIGS. 5*b* and 6*b*, the height of the weight element 20 is dimensioned such that an upper portion of the weight element 20 extends past the lower edge 44 of the rear opening 40. Thus, the upper portion is visible within the rear opening 40 from the rear face 32 of the golf club head 14. In this particular exemplary embodiment, the apertures 70 are positioned proximate a top portion of the weight element 20. Thus, the apertures 70 are positioned between the upper edge 42 and the lower edge 44. As further shown in FIG. 6*b*, the planar rear surface 68 confronts the inner surface 54 of the ball striking face 28. In an exemplary embodiment, the rear surface 68 is in surface-to-surface engagement with the inner surface 54. Similarly, the first front surface 66 confronts the inner surface 54 of the rear face 32. The front surface 66 may or may not be in surface-to-surface engagement with the inner surface 54 of the rear face 32. As discussed, the weight element 20 is cooperatively dimensioned with the slot 48. The cooperative dimensioned configuration may be such that the weight element 20 fits within the slot 48 in generally an interference fit.

Figure 6A:
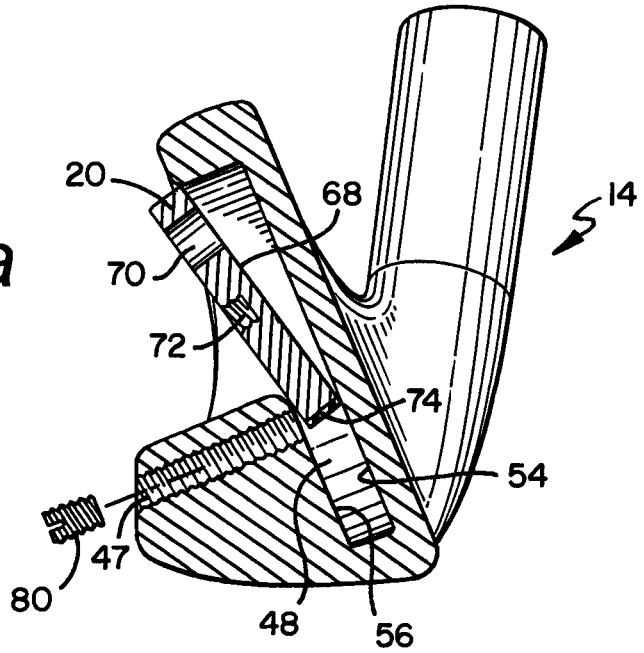
FIG. 6*a* is a cross-sectional view of the golf club head taken along lines 4-4 shown in FIG. 3 and further showing a cross-sectional view of a weight element or weight element being inserted into the golf club head body.
Figure 6B:
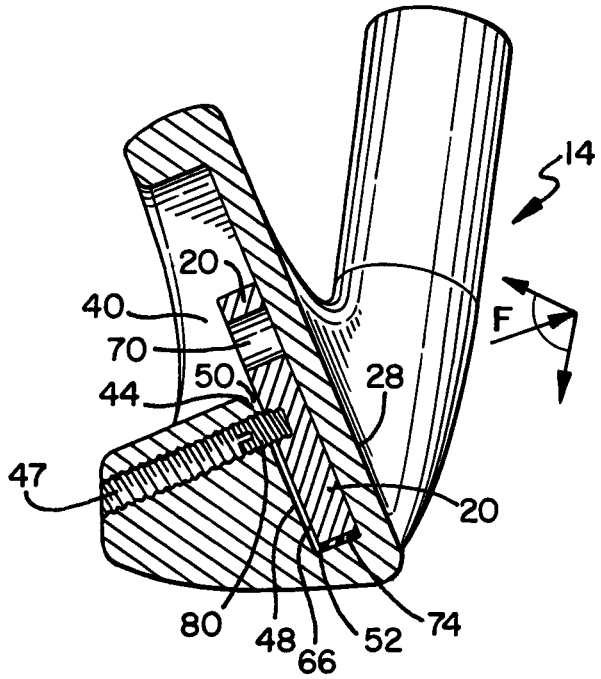
FIG. 6*b* is a cross-sectional view of the golf club head shown in FIG. 6*a* and showing the weight element in a secured position.

As further shown in FIG. 6*b*, the threaded opening 72 of the weight element 20 is aligned with the threaded opening 47 of the rear face 32. A fastener 80 is provided and inserted through the threaded opening 47 in the rear surface 32 and into the threaded opening 72 of the weight element 20 wherein the weight element is secured within the slot 48. In such configuration, the second surface 68 of the weight element 20 is in surface-to-surface engagement with the inner surface 54 of the ball striking face 28. A small gap may be present between the first surface 66 of the weight element and the inner surface 56 of the rear face 32. In such configuration, the weight element 20 is subject to a force F (FIG. 6*b*) that forces the weight element 20 against the inner surface 54 of the ball striking face 28. In an exemplary embodiment, the force F applied is generally normal to or generally perpendicular to the inner surface 54 of the ball striking face 28. Thus, the weight element 20 is forced against the inner surface 54 of the ball striking face 28. It is understood that the threaded openings 47,72 can be modified such that the force F could vary from being normal to or perpendicular to the inner surface 54 of the ball striking face 28. For example, the force F can be applied generally in directions spanning 90 degrees around the normal force F. In another exemplary embodiment, the force F could be configured to be applied at an angle towards the sole portion 30 of the body 18 so as to force the weight member further into a bottom portion of the slot 48. Forcing the weight element 20 against the inner surface 54 of the ball striking face 28 can improve the overall feel of the club 10. It is also understood that the threaded opening 72 on the weight element 20 can be eliminated wherein the fastener 80 would merely engage the front surface 66 of the weight element 20. It is understood that the weight element 20 and slot 48 can be configured to connect in an interference fit such that a separate fastener 80 is not used. In an exemplary embodiment, the interference fit is configured to force the weight element 20 against the inner surface 54 of the ball striking face 28. The weight element 20 can further be forced in alternate directions.

As further shown in FIGS. 5*a*-7*b*, the weight element 20 in this exemplary embodiment has a plurality of apertures 70 proximate a top portion of the weight element 20. In such configuration, more weight is focused at a lower portion of the weight element 20 and thus the golf club head 14, when the weight element 20 is secured therein. Accordingly, the golf club head 14 has a low center of gravity configuration. The low center of gravity configuration assists the golfer in hitting golf shots having higher trajectories or higher launch angles and, therefore, higher arc along with lower ball spin.

It is understood that in certain alternative embodiments, the weight element 20 may include a shock absorbing member associated therewith. For example, a resilient member may be connected or otherwise deposited and affixed to the weight element 20. In one example, the resilient member may take the form of a polymeric member such as a rubber coating and positioned on the rounded edges 62 and bottom edge 64. The member can also be deposited on the first surface 66 and second surface 68. The rubber coating is shown schematically in FIG. 5*a* and designated with the reference numeral 74. The rubber coating 74 can assist in providing an interference or friction fit wherein a separate fastener may be eliminated. The shock absorbing member 74 may also provide vibration dampening characteristics.

FIGS. 8*a*-8*c* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. The weight element 20 has a plurality of apertures 70 positioned proximate a lower portion of the weight element 20. As shown in FIG. 8*c*, the weight element 20 is positioned in the slot 48 through the rear opening 40 consistent with the description above. A top portion of the weight element 20 extends past the lower edge 44. The apertures 70 are positioned within the slot 48 proximate the second end 52. The fastener 80 is threaded into the openings 47, 72 to secure the weight element 20 to the golf club head body 18 to form the golf club head 14. As previously discussed, the weight element 20 is forced against the inner surface 54 of the ball striking face 28. As the apertures 70 are positioned in a lower portion of the weight element 20, the weight of the weight element 20 is focused towards a top portion of the element 20. When secured to the body 18, weight is therefore focused towards an upper portion of the golf club head 14. The golf club head 14 consequently has a high center of gravity configuration in FIGS. 8*a*-8*c*. It is noted that a high center of gravity configuration such as shown in FIGS. 8*a*-8*c* is not a typical configuration. However, it has been discovered that this configuration is useful for a golfer having a swing tendency wherein the golfer often hits the golf ball "fat." Such configuration will improve ball trajectory with this type of swing. The high center of gravity configuration assists the golfer in hitting golf shots having lower, boring trajectories and wherein the ball has higher spin rates. The golfer can achieve better control on such shots.

Figure 9B:
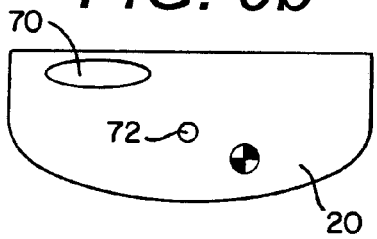
FIG. 9*b* is a rear elevation view of the weight element shown in FIG. 9*a;*
Figure 9A:
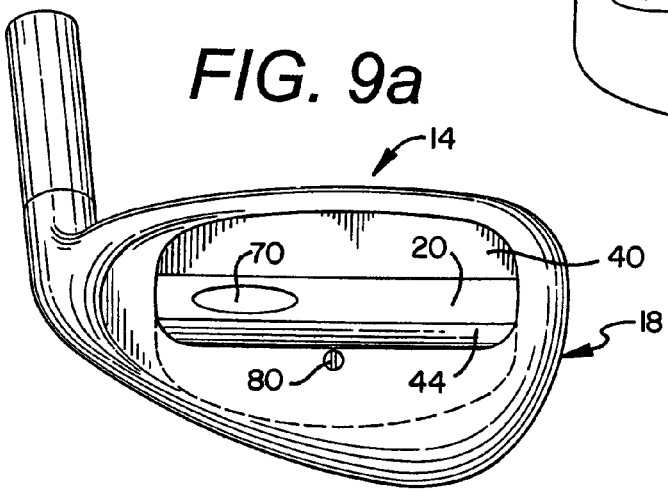
FIG. 9*a* is a rear elevation view of an alternative embodiment of a golf club head in accordance with the present invention.

FIGS. 9*a*-9*b* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. The weight element 20 has an aperture 70 positioned proximate a top edge and a side edge of the weight element 20. As shown in FIG. 9*b*, the aperture 70 is positioned in the upper left-hand portion of the weight element 20. As shown in FIG. 9*a*, the weight element 20 is positioned in the slot 48 through the rear opening 40 consistent with the description above. A top portion of the weight element 20 extends past the lower edge 44. The aperture 70 is positioned within the slot 48 proximate the second end 52. The fastener 80 is threaded into the openings 47, 72 to secure the weight element 20 to the golf club head body 18 to form the golf club head 14. The weight element 20 is forced against the inner surface 54 of the ball striking face 28. The aperture 70 is visible in the rear opening 40. As the aperture 70 is positioned proximate the top edge and side edge of the weight element, and positioned towards the heel portion 22, the weight of the weight element 20 is focused towards an opposite side of the element 20. When secured to the body 18, the aperture 70 is positioned proximate the heel portion 22 wherein the weight is therefore focused towards the toe portion 24 of the golf club head 14. The golf club head 14 consequently has a "low-toe" center of gravity configuration in FIGS. 9*a*-9*b*. The low-toe center of gravity configuration assists the golfer in hitting golf shots having higher launch trajectories and lower spin. For a right handed golfer, this configuration assists the golfer in hitting left to right shots or a fade type shot.

Figure 10B:
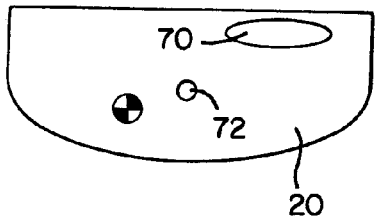
FIG. 10*b* is a rear elevation view of the weight element shown in FIG. 10*a;*
Figure 10A:
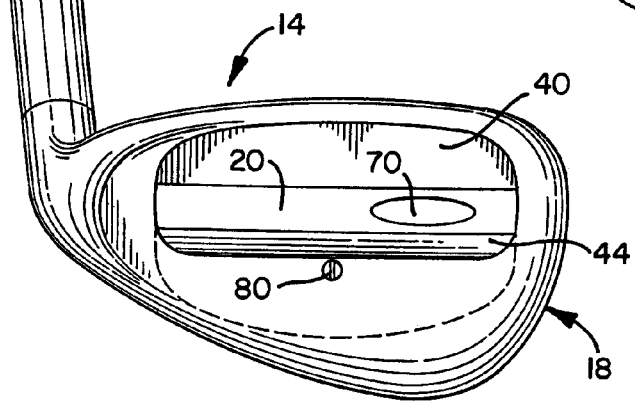
FIG. 10*a* is a rear elevation view of an alternative embodiment of a golf club head in accordance with the present invention.

FIGS. 10-10*b* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. The weight element 20 has an aperture 70 positioned proximate a top edge and a side edge of the weight element 20. As shown in FIG. 10*b*, the aperture 70 is positioned in the upper right-hand portion of the weight element 20. As shown in FIG. 10*a*, the weight element 20 is positioned in the slot 48 through the rear opening 40 consistent with the description above. A top portion of the weight element 20 extends past the lower edge 44. The fastener 80 is threaded into the openings 47, 72 to secure the weight element 20 to the golf club head body 18 to form the golf club head 14. The weight element 20 is forced against the inner surface 54 of the ball striking face 28. It is understood that the threaded opening 72 could be configured to allow the weight element 20 shown in FIG. 9*b* to be rotated about a vertical axis to the position shown in FIG. 10*b*. The aperture 70 is visible in the rear opening 40. As the aperture 70 is positioned proximate the top edge and side edge of the weight element 20, and positioned towards the toe portion 24, the weight of the weight element 20 is focused towards an opposite side of the element 20. When secured to the body 18, the aperture 70 is positioned proximate the toe portion 24 wherein the weight is therefore focused towards the heel portion 22 of the golf club head 14. The golf club head 14 consequently has a "low-heel" center of gravity configuration in FIGS. 10*a*-10*b*. The low-heel center of gravity configuration assists the golfer in hitting golf shots having higher trajectories or higher launch angles and, therefore, higher arc along with lower ball spin. For a golfer such as a right hand golfer, assistance is provided for right to left golf shots, or draw type shots.

Figure 11B:
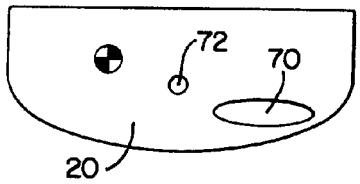
FIG. 11*b* is a rear elevation view of the weight element shown in FIG. 11*a;*
Figure 11A:
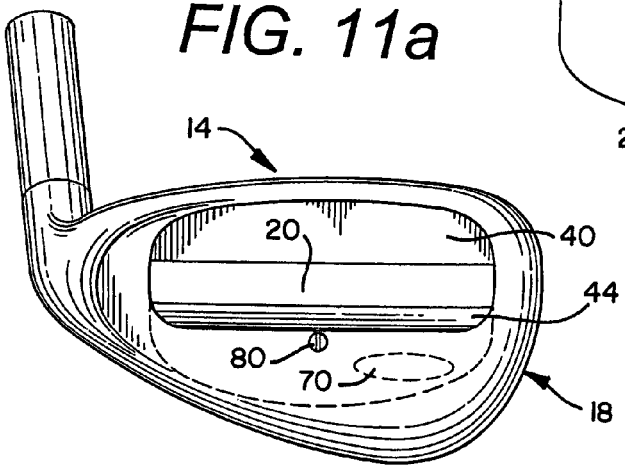
FIG. 11*a* is a rear elevation view of an alternative embodiment of a golf club head in accordance with the present invention.

FIGS. 11*a*-11*b* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. The weight element 20 has an aperture 70 positioned proximate a bottom edge and a side edge of the weight element 20. As shown in FIG. 11*b*, the aperture 70 is positioned in the lower right-hand portion of the weight element 20. As shown in FIG. 11*a*, the weight element 20 is positioned in the slot 48 through the rear opening 40 consistent with the description above. A top portion of the weight element 20 extends past the lower edge 44. The aperture 70 is positioned within the slot 48 towards the second end 52. The fastener 80 is threaded into the openings 47, 72 to secure the weight element 20 to the golf club head body 18 to form the golf club head 14. The weight element 20 is forced against the inner surface 54 of the ball striking face 28. As the aperture 70 is positioned proximate the bottom edge and side edge of the weight element 20, and positioned towards the toe portion 24, the weight of the weight element 20 is focused towards an opposite side of the element 20. When secured to the body 18, the aperture 70 is positioned proximate the toe portion 24 wherein the weight is therefore focused towards the heel portion 22 of the golf club head 14. The golf club head 14 consequently has a "high-heel" center of gravity configuration in FIGS. 11*a*-11*b*. The high-heel center of gravity configuration assists the golfer in hitting golf shots having lower trajectories, or lower boring launch angles with higher ball spin. For a golfer such as a right hand golfer, the configuration assists in hitting right to left golf shots, or draw type shots.

Figure 12B:
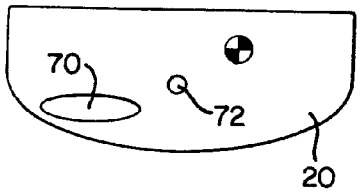
FIG. 12*b* is a rear elevation view of the weight element shown in FIG. 12*a;*
Figure 12A:
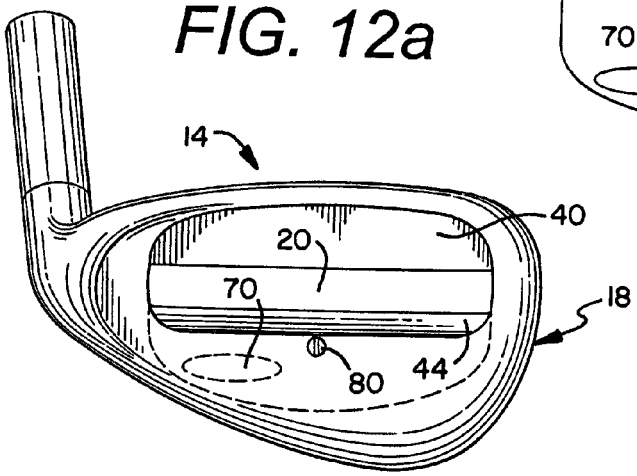
FIG. 12*a* is a rear elevation view of an alternative embodiment of a golf club head in accordance with the present invention.

FIGS. 12*a*-12*b* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. The weight element 20 has an aperture 70 positioned proximate a bottom edge and a side edge of the weight element 20. As shown in FIG. 12*b*, the aperture 70 is positioned in the lower left-hand portion of the weight element 20. As shown in FIG. 12*a*, the weight element 20 is positioned in the slot 48 through the rear opening 40 consistent with the description above. A top portion of the weight element 20 extends past the lower edge 44. The fastener 80 is threaded into the openings 47, 72 to secure the weight element 20 to the golf club head body 18 to form the golf club head 14. The weight element 20 is forced against the inner surface 54 of the ball striking face 28. It is understood that the threaded opening 72 could be configured to allow the weight element 20 shown in FIG. 11*b* to be rotated about a vertical axis to the position shown in FIG. 12*b*. The aperture 70 is positioned within the slot 48 proximate the second end 52 and is not visible in the rear opening 40. As the aperture 70 is positioned proximate the bottom edge and side edge of the weight element 20, and positioned towards the heel portion 22, the weight of the weight element 20 is focused towards an opposite side of the element 20. When secured to the body 18, the aperture 70 is positioned proximate the heel portion 22 wherein the weight is therefore focused towards the toe portion 24 of the golf club head 14. The golf club head 14 consequently has a "high-toe" center of gravity configuration in FIGS. 12*a*-12*b*. The high-toe center of gravity configuration assists the golfer in hitting golf shots having lower trajectories, or lower boring launch angles with higher ball spin. For a right hand golfer, the configuration assists in hitting left to right golf shots, or fade type shots.

FIGS. 13*a*-13*c* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. The weight element 20 has a first aperture 70 positioned proximate a top edge of the weight element 20 and at a central location of the weight element 20. The weight element 20 also has a second aperture 70 positioned proximate a bottom edge of the weight element 20 and at a central location of the weight element 20. As shown in FIG. 13*b*, the apertures 70 are positioned generally at an upper central location and at a lower central location of the weight element 20. As shown in FIGS. 13*a* and 13*c*, the weight element 20 is positioned in the slot 48 through the rear opening 40 consistent with the description above. A top portion of the weight element 20 extends past the lower edge 44. The first aperture 70 is positioned within the rear opening 40 and the second aperture 70 is positioned within the slot 48 proximate the second end 52. The fastener 80 is threaded into the openings 47, 72 to secure the weight element 20 to the golf club head body 18 to form the golf club head 14. The weight element 20 is forced against the inner surface 54 of the ball striking face 28. As the apertures 70 are positioned proximate the top edge and bottom edge of the weight element, the weight of the weight element 20 is focused at opposite lateral side portions of the weight element 20. When secured to the body 18, the apertures 70 are positioned at upper and lower central locations of the weight element and wherein the weight is therefore focused towards the heel portion 22 and the toe portion 24 of the golf club head 14. The golf club head 14 of FIGS. 13*a*-13*c* consequently has a configuration that may be considered as maximizing a moment of inertia associated with the golf club head 14. In this configuration, a higher moment of inertia is achieved and assists in golf shots having a higher ball flight with lower ball spin.

FIGS. 14*a*-14*c* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. The weight element 20 has an aperture 70 positioned proximate a top edge of the weight element 20. As shown in FIG. 14*b*, the aperture 70 has a first horizontal section 70*a* and second vertical section 70*b* that is generally transverse to the first section 70*a*. The aperture 70 may be considered T-shaped. As shown in FIG. 14*c*, the weight element 20 is positioned in the slot 48 through the rear opening 40 consistent with the description above. A top portion of the weight element 20 extends past the lower edge 44. The first section 70*a* of the aperture 70 is visible in the rear opening 40. The second section 70*b* may extend into the slot 48. The fastener 80 is threaded into the openings 47, 72 to secure the weight element 20 to the golf club head body 18 to form the golf club head 14. The weight element 20 is forced against the inner surface 54 of the ball striking face 28. The aperture 70 is visible in the rear opening 40. It is understood that the second vertical section 70*b* of the aperture 70 may be extended further downwards (shown in phantom) wherein the threaded apertures can be modified accordingly to allow for securing the weight element 20. As the aperture 70 has a T-shaped configuration, weight may be focused towards the lower side edges of the weight element 20. The golf club head 14 of FIGS. 14*a*-14*c* may be considered to have a low center of gravity and high moment of inertia configuration. In this configuration, a highest moment of inertia and a low center of gravity is achieved. This assists in golf shots having higher ball flight with lower ball spin and more balanced lateral golf shots.

FIG. 15 discloses another exemplary embodiment of the golf club head 14 in accordance with the present invention. Similar structures will be designed with similar reference numerals. Accordingly, the golf club head 14 includes a golf club head body 18 and a weight element 20. The golf club head body 18 is similar to the golf club head body 18 shown in FIGS. 1-7*a*. The slot 48 shown in FIG. 15 has a first section 48*a* and a second section 48*b*. The second section 48*b* is generally transverse to the first section 48*b*. It is understood that other structures of the golf club head 14 may be constructed to allow for the formation of the second section 48*b*. The second section 48*b* extends towards the rear face 32 of the body 18. As further shown in FIG. 15, the weight element 20 has a lip 90 extending from a bottom edge of the weight element 20. The lip 90 could be integral with the weight element 20. The lip 90 could also be a separate member attached to the weight element 20. In one exemplary embodiment, the lip 90 is a rigid member, but sufficiently resiliently flexible. In this configuration, the weight element 20 can be inserted into the first section 48*a* of the slot 48 wherein the lip 90 deflects until the lip 90 is received by the second section 48*b*. With this configuration, the weight element 20 is secured within the slot 48 without the need for a separate fastener 80. It is understood that the slot 48 and weight element 20 can be cooperatively dimensioned, including the lip 90 to provide an interference fit or biasing configuration wherein the weight element 20 is forced against the inner surface 54 of the ball striking face 28. Other aspects of the golf club head 14 are similar to aspects as described above.

Figure 16A:
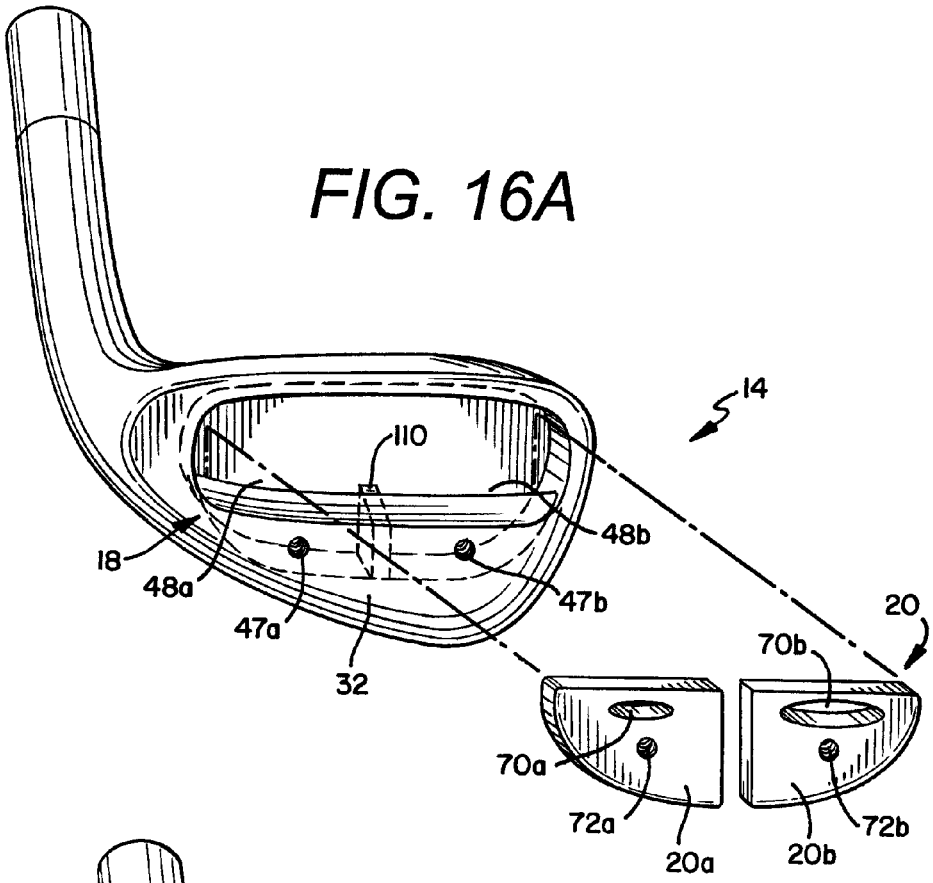
FIG. 16*a* shows a rear perspective exploded view of an alternative embodiment of a golf club head in accordance with the present invention.
Figure 16B:
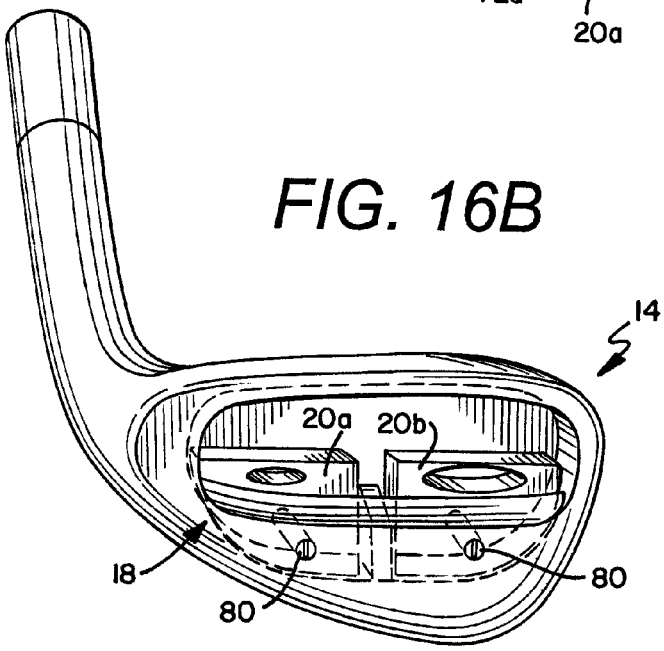
FIG. 16*b* shows a rear perspective view of the golf club head of FIG. 16*a;*

FIGS. 16*a*-16*b* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally the same as the golf club head body 18 shown in FIGS. 1-7*a*. In the embodiment of FIGS. 16*a*-16*b*, however, the body 18 has a dividing wall 110 wherein the slot in the body 18 has a first slot 48*a* and a second slot 48*b*. The dividing wall 110 may be integral with the body 18 or can be separately affixed to the body 18. The dividing wall 110 extends from an inner surface 54 of the ball striking face 28 to the inner surface 56 of the rear face 32. It is further understood that the dividing wall 110 can be eliminated if desired. The rear face 32 further has a first threaded opening 47*a* and a second threaded opening 47*b*. As further shown in FIG. 16*a*, the weight element 20 comprises a first weight element 20*a* and a second weight element 20*b*. The first weight element 20*a* has a first aperture 70*a*, and the second weight element 20*b* has a second aperture 70*b*. Also, the first weight element 20*a* has a first threaded opening 72*a*, and the second weight element 20*b* has a second threaded opening 72*b*. In one exemplary embodiment, the first aperture 70*a* is smaller than the second aperture 70*b*.

As further shown in FIG. 16*b* and consistent with the discussion above, the first weight element 20*a* is positioned in the first slot 48*a* and secured therein with a fastener 80 positioned in the openings. Similarly, the second weight element 20*b* is positioned in the second slot 48*b* and secured therein with a fastener 80. The peripheral edges of the slots 48*a*,48*b* and weight elements 70*a*,70*b* are contoured and dimensioned to generally correspond. Consistent with the discussion above, the weight elements 20*a*,20*b* are forced against the inner surface of the ball hitting face in a generally perpendicular configuration. It is understood that the embodiment of FIGS. 16*a*-16*b* provides a user the ability to further fine tune center of gravity characteristics of the golf club head 14. As discussed, the size of the apertures 70*a*,70*b* can be varied as desired. The apertures 70*a*,70*b* can also be positioned at various locations on the weight elements 20*a*,20*b* as discussed and disclosed above. Accordingly, the size and particular placement of the apertures 70*a*,70*b* on separate weight elements 20*a*,20*b* allows further potential combinations for various center of gravity configurations. It is further understood that the weight elements 20*a*,20*b* can be rotated about a vertical axis to be interchangeable between the slots 48*a*,48*b*. In such instance, the threaded openings 72*a*,72*b* may be positioned completely through the weight elements 20*a*,20*b*. Alternatively, the threaded openings 72*a*,72*b* could be eliminated wherein the fastener 80 engages a surface of the weight element 20*a*,20*b*.

FIGS. 17*a*-17*b* disclose another exemplary embodiment of the golf club head 14 in accordance with the present invention. Similar structures will be designed with similar reference numerals. Accordingly, the golf club head 14 includes a golf club head body 18 and a weight element 20. The golf club head body 18 is generally similar as the golf club head body 18 shown in FIGS. 1-7*a*. In the embodiment of FIGS. 17*a*-17*b*, the body 18 also has the dividing wall 110 as in FIGS. 16*a*-16*b*, wherein the slot in the body 18 has a first slot 48*a* and a second slot 48*b*. As further shown in FIG. 17*a*, the first slot 48*a* and the second slot 48*b* may be configured to be generally squared or rectangular in shape. As such, the planar surfaces 49 are formed proximate the heel end and the toe end at the first end of the slots 48*a*,48*b*. As further shown in FIG. 17*a*, the weight element 20 has a first weight element 20*a* and a second weight element 20*b*. The weight elements 20*a*,20*b* have respective apertures 70*a*,70*b* and threaded openings 72*a*,72*b*. The weight elements 20*a*,20*b* are generally squared or rectangular in shape, and generally cooperatively dimensioned to correspond to the shape of the slots 48*a*,48*b*.

As further shown in FIG. 17*b* and consistent with the discussion above, the first weight element 20*a* is positioned in the first slot 48*a* and secured therein with a fastener 80 positioned in the openings. Similarly, the second weight element 20*b* is positioned in the second slot 48*b* and secured therein with a fastener 80. As discussed, the rectangular configurations of the slots 48*a*,48*b* and weight elements 20*a*,20*b* are contoured and dimensioned to generally correspond. Consistent with the discussion above, the weight elements 20*a*,20*b* are forced against the inner surface of the ball hitting face in a generally perpendicular configuration. Like the embodiment of FIGS. 16*a* and 16*b*, it is understood that the embodiment of FIGS. 17*a*-17*b* provides a user the ability to further fine tune center of gravity characteristics of the golf club head 14. As discussed, the size of the apertures 70*a*,70*b* can be varied as desired. The weight elements 20*a*,20*b* can also be rotated, for example, about a horizontal axis to modify the location of the apertures 70*a*,70*b* in the body 18 to affect center of gravity. The apertures 70*a*,70*b* can also be positioned at various locations on the weight elements as discussed and disclosed above.

FIG. 18 disclose another exemplary embodiment of the golf club head 14 in accordance with the present invention.

Similar structures will be designed with similar reference numerals. Accordingly, the golf club head 14 includes a golf club head body 18 and a weight element 20. The weight element 20 may have an aperture 70 similar to the weight elements discussed above. The weight element 20 has a tapered rear side 120 and the body 18 has a slot 48 having a similarly tapered edge 122. The slot 48 is tapered upwards and towards the rear face 32 of the body 18. The rear face 32 has a threaded opening 47 and the weight element 20 may also have a threaded opening 72. Consistent with the discussion above, a fastener 80 is positioned through the threaded openings 47,72 wherein the weight element 20 is forced against the inner surface 54 of the ball striking face 28. The force is generally normal or perpendicular to the inner surface 54. As can be appreciated from FIG. 18, the weight element 20 has additional structure and therefore, mass, towards the rear of the body 18. Thus, additional fine tuning of center of gravity configurations can be achieved. Other aspects of the golf club head 14 are consistent with the discussion above.

FIG. 19 discloses another exemplary embodiment of the golf club head 14 in accordance with the present invention. Similar structures will be designed with similar reference numerals. Accordingly, the golf club head 14 includes a golf club head body 18 and a weight element 20. As shown in FIG. 19, the golf club head body 18 has a first slot 48*c* and a second slot 48*d*. The first slot 48*c* is positioned adjacent the inner surface 54 of the ball striking face 28, and the second slot 48*d* is positioned adjacent the rear face 32. The first slot 48*c* is separated from the second slot 48*d* by an internal wall 130. The weight element 20 has a first weight element 20*c* and a second weight element 20*d*. The first weight element 20*c* has a larger bottom dimension wherein the first slot 48*c* is enlarged to accommodate this larger dimension. The second weight element 20*d* is similar to the weight elements 20 described above. The rear face 32, the internal wall 130, and the weight elements 20*c*,20*d* all may have corresponding openings to receive a fastener 80 to secure the weight elements in the body 18. In the fastened state, the first weight element 20*c* is proximate and forced against the inner surface 54 of the ball striking face 28, and the second weight element 20*d* proximate the rear face 32 of the body 18 and may also be forced against the inner wall 130. The multiple slot/multiple weight element configuration of FIG. 19 allows further potential combinations for fine tuning center of gravity configurations. It is further understood that the golf club head 14 can be configured to only include the second weight element 20*d* wherein the first weight element 20*c* is eliminated. Thus, the weight element 20*d* can be fastened in the second slot 48*d* and the first slot 48*c* is left open. The position of the internal wall 130 can also vary between the ball striking face 28 and rear face 32 of the club head 14. The overall height of the internal wall 130 could also vary. In this design, the first slot 48*c* may have a depth D and the weight element 20*d* may have a width W such that the D/W ratio may be greater than 2, similar to the configuration discussed above. In addition, rather than utilizing the opening at the rear of the golf club head 14, an opening 14 can be provided in the toe end of the golf club head 14 wherein the weight element is slid into the slot from the toe end.

It is further understood that the slot 48 and weight elements 20 can have tapered surfaces. The tapered surfaces can be configured such that upon insertion of the weight element 20 into the slot 48, the weight element is forced against the inner surface 54 of the ball striking face 28.

The weight element 20 may further have other characteristics. Depending on the particular weight element 20 selected, the weight element 20 is used to alter, position, customize, and "fine-tune" the weight and the center of gravity of the golf club head 14. Thus, the various weight elements 20 can be used, for example, to selectively alter, position, customize, and "fine-tune" weight in the club head structure 14, e.g., to produce a consistent club "swing weight" throughout a set, to produce a draw biased club, to produce a fade biased club, to help compensate for swing faults that tend to produce a hooking ball flight, to help compensate for swing faults that tend to produce a slicing ball flight, to help particular shot making abilities etc. As discussed, the weight element 20 may substantially fill the slot 48. Incorporation of the resilient member may also assist in dampening vibration produced, for example, when the golf club head 14 contacts a golf ball, and thereby alter the sound and/or reduce the vibrational response transmitted to the golfer's hands.

The weight elements 20 may be of any desired mass or construction, and they may have the apertures 70 selectively placed at any desired positions to produce a desired effect. For example, in some golf club head structures in accordance with this invention, the weight elements 20 may be constructed so as to produce a club having a desired "swing weight". Every iron club in a set may be selectively weighted so as to have the same "swing weight," which helps provide a more consistent swing feel for users throughout the set. It is further understood that utilizing the various weight elements 20 allows the golfer to alter or shift the center of gravity of the golf club head 14 as well as alter the moment of inertia properties of the golf club head 14. The various weight elements 20 having the apertures 70 at various locations can be used to customize the golf club head 14 as desired for the particular swing of the golfer. Depending on the swing characteristics of the golfer, the golfer can use a different weight element for each golf club head in a set of irons (e.g., 3-iron or 4-iron through pitching wedge or sand wedge).

If desired, however, weight elements 20 also may be selectively located (with selected masses) so as to affect ball flight. For example, providing additional weight in the club head toe portion (by using the weight element 20 having an aperture proximate the heel portion 22), a club head can be biased to produce more of a "fading" ball flight and/or a club head can be designed to help compensate for swing flaws that tend to produce a "hooking" ball flight. On the other hand, by providing additional weight in the club head heel end (by using the weight element 20 having apertures located toward the toe portion 24), a club head can be biased to produce more of a "drawing" ball flight and/or a club head can be designed to help compensate for swing flaws that tend to produce a "slicing" ball flight. Weight elements 20 of the types described above can be used both swing weighting and ball flight biasing purposes, if desired.

As mentioned above, golf club heads in accordance with examples of the present invention may be incorporated into a set, e.g., a set of iron and/or hybrid type golf clubs. For example, aspects of the present invention may be used to provide a club set with increasing numbered iron golf clubs, such as two or more of hybrid type clubs, driving irons, a zero iron, a one iron, a two iron, a three iron, a four iron, a five iron, a six iron, a seven iron, an eight iron, a nine iron, a ten iron, a pitching wedge, a lob wedge, a gap wedge, a sand wedge, etc. With the present invention, a golfer, a club designer, and/or a club fitter may modify swing weight and/or the position of the center of gravity for each golf club to meet the player's unique requirements, skill, or playing style (e.g., to provide a consistent swing "feel" throughout the set, to bias for certain desired ball flight characteristics, etc.). For each club in the set, the insert member (and/or other features of the club head, such as perimeter weighting members, weighting members, etc) may progressively change to alter the center of gravity of one club member with respect to the others in the set, to make the center of gravity better suited for use of the particular club, optionally customized for use by a specific golfer. Thus, it is understood that utilizing the various weight elements 20 having the apertures 70 at different locations allows the golfer to shift the center of gravity in a particular golf club head 14 as desired. Accordingly, the golfer can use the different weight elements 20 to provide different club center of gravity configurations including: low center of gravity configuration (FIGS. 5*a*-7*b*), high center of gravity configuration (FIGS. 8*a*-8*c*), low toe portion center of gravity configuration (FIGS. 9*a*-9*b*), low heel portion center of gravity configuration (FIGS. 10*a*-10*b*), high heel portion center of gravity configuration (FIGS. 11*a*-11*b*), high toe portion center of gravity configuration (FIGS. 12*a*-12*b*), maximized moment of inertia configuration (FIGS. 13*a*-13*b*), and lower center of gravity/high moment of inertia configuration (FIGS. 14*a*-14*c*). The ability to adjust the center of gravity in the golf club head 14 in this fashion will improve the golfer's shot making capabilities. In sum, use of the variety of weight elements allows the golfer to focus weight on the golf club head 14 where desired and to remove weight on the golf club head 14 where weight is not desired. Various "feel" characteristics of the club also may be controlled, as described above.

Also, while the invention has been described primarily in terms of use in an iron type golf club head (including iron type hybrid golf club heads), those skilled in the art will appreciate that aspects and features of this invention are not limited to use with iron type golf club heads. For example, if desired, putter type and/or wood type body members may be substituted for the iron type club head body members illustrated in FIGS. 1 through 15, and the same or similar features and/or structures could be included in a putter or wood structure without departing from this invention.

In addition to the increased ability and options to alter center of gravity and moment of inertia aspects of the golf club head, additional benefits are also realized. The cooperative dimensions between the slot and the weight element allows the weight elements to be easily changed and the weight elements easily secured within the golf club head. The extended depth of the slot and vertical component of the slot assist in securing the weight element within the golf club head. Consequently, only a single fastener is used for further securing and certain embodiments do not require a separate fastener. It is understood that additional apertures/openings can be provided in the club head and weight elements to provide additional fastening configurations. In addition, utilizing weight elements having apertures to control the overall weight of the element as well as location of the weight enhances the design. Rather than requiring specifically weighted weight elements to be positioned at specific locations in the club head, one of the various weight elements having an aperture(s) in a particular location can be selected and inserted into the slot of the golf club head. This further allows the weight elements to be formed from more traditional materials such as stainless steel since each element can possess at least a typical mass. Also, the general shape of the weight element can remain constant to be consistently dimensioned to be received in the slot wherein the size of the aperture can be varied depending on the mass desired. When utilizing systems where specific weight elements are inserted into receiving members in the golf club head, the weight elements usually require additional mass and are required to be made from more expensive materials such as tungsten. In an exemplary embodiment of the present invention, the weight elements can be constructed from stainless steel at a more economical cost. Finally, it is understood that the apertures in the weight elements can vary in size depending on the desired weight of the element. The apertures can be contained within the outer peripheral edges of the weight element or could extent to outer peripheral edges thus providing a pathway from the outer peripheral edge and towards an inner portion of the weight element.

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1-19 may be used individually and/or in any combination or subcombination without departing from this invention.

What is claimed is:

1. An iron type golf club head comprising:

a body having a ball striking face, a rear face opposite the ball striking face and a sole portion positioned between the ball striking face and the rear face, the rear face having an opening in communication with a slot positioned in the body;

a weight element positioned in the slot through the opening, wherein the weight element has at least one aperture therethrough to define a removed weight portion that remains void of material; and wherein the rear face further has a bore therethrough and in communication with the slot, and further comprising a fastener positioned in the bore and engaging the weight element to secure the weight element in the slot.

2. The iron type golf club head of claim 1 wherein the weight element is stainless steel.

3. The iron type golf club head of claim 1 wherein the aperture comprises a pair of apertures.

4. The iron type golf club head of claim 1 wherein the slot is defined between an inner surface of the ball striking face and an inner surface of the rear face.

5. The iron type golf club head of claim 1 wherein the slot extends from the sole portion to proximate a mid portion of the rear face.

6. The iron type golf club head of claim 1 wherein the slot extends from the sole portion to a location under a mid portion of the rear face.

7. The iron type golf club head of claim 1 wherein the weight element extends upwards past the opening.

8. The iron type golf club head of claim 1 wherein the slot extends to a top portion of the sole portion.

9. The iron type golf club head of claim 1 wherein the slot extends to proximate a mid portion of the rear face to define a slot opening, the opening in the rear face having a lower edge generally coinciding with a first end of the slot, the opening having an upper edge; wherein the weight element has a top edge positioned between the upper edge and the lower edge when the weight element is positioned in the slot.

10. The iron type golf club head of claim 9 wherein the weight element has an aperture wherein the aperture is positioned between the upper edge and the lower edge when the weight element is positioned in the slot.

11. The iron type golf club of claim 1 wherein the weight element has a bore aligned with the bore of the rear face, the fastener positioned in the bore of the rear face and the bore of the weight element to secure the weight element in the slot.

12. The iron type golf club of claim 1 wherein the weight element is forced against an inner surface of the ball striking face.

13. The iron type golf club of claim 12 wherein the force applied to the weight element is generally perpendicular to the inner surface.

14. The iron type golf club head of claim 1 wherein the weight element has a shock absorbent member attached thereto.

15. The iron type golf club head of claim 1 wherein the weight element has an aperture proximate a bottom edge of the weight element.

16. The iron type golf club head of claim 15 wherein the aperture comprises a pair of apertures proximate the bottom edge of the weight element.

17. The iron type golf club head of claim 1 wherein the weight element has an aperture proximate a top edge of the weight element.

18. The iron type golf club head of claim 17 wherein the aperture comprises a pair of apertures proximate the top edge of the weight element.

19. The iron type golf club head of claim 1 wherein the weight element has an aperture proximate a top edge and a side edge of the weight element, the weight element positioned in the slot wherein the aperture is positioned proximate a heel of the body.

20. The iron type golf club head of claim 1 wherein the weight element has an aperture proximate a top edge and a side edge of the weight element, the weight element positioned in the slot wherein the aperture is positioned proximate a toe of the body.

21. The iron type golf club head of claim 1 wherein the weight element has an aperture proximate a bottom edge and a side edge of the weight element, the weight element positioned in the slot wherein the aperture is positioned proximate a toe of the body.

22. The iron type golf club head of claim 1 wherein the weight element has an aperture proximate a bottom edge and a side edge of the weight element, the weight element positioned in the slot wherein the aperture is positioned proximate a heel of the body.

23. The iron type golf club head of claim 1 wherein the slot has a first section and a second section, generally transverse to the first section, the weight element having a lip received by the second section when the weight element is positioned in the slot.

24. The iron type golf club head of claim 1 wherein the weight element comprises a first weight element and a second weight element.

25. The iron type golf club head of claim 1 wherein the slot and the weight element have cooperatively dimensioned tapered surfaces extending towards the rear face of the body.

26. The iron type golf club head of claim 1 wherein the slot comprises a width defined as the distance between an inner surface of the ball striking face and an inner surface of the rear face, and a depth defined as the distance from a first end of the slot to a second end of the slot into the body, wherein the ratio of the maximum overall depth to the maximum overall width is equal to or greater than 2.

27. An iron type golf club head comprising:

a body having a ball striking face, a rear face opposite the ball striking face and a sole portion positioned between the ball sinking face and the rear face the rear face having an opening in communication with a slot positioned in the body;

a weight element positioned in the slot through the opening, wherein the weight element has at least one aperture therethrough to define a removed weight portion that remains void of material; and wherein the rear surface further has a bore therethrough and in communication with the slot, and further comprising a fastener positioned in the bore and forcing the weight element against an inner surface of the ball striking face to secure the weight element in the slot.

28. The iron type golf club of claim 27 wherein the force applied to the weight element is generally perpendicular to the inner surface.

29. An iron type golf club head comprising:

a body having a ball striking face, a rear face opposite the ball striking face and a sole portion positioned between the ball striking face and the rear face, the rear face having an opening in communication with a slot positioned in the body;

a weight element positioned in the slot through the opening, wherein the weight element has at least one aperture therethrough to define a removed weight portion that remains void of material;

wherein the weight element has a shock absorbent member attached thereto; and wherein the weight element has a first side edge and a second side edge and a bottom edge, wherein the shock absorbent member is positioned on the first side edge, the second side edge and the bottom edge.

30. The iron type golf club head of claim 29 wherein the shock absorbent member is a polymeric material.

31. An iron type golf club head comprising:

a body having a ball striking face, a rear face opposite the ball striking face and a sole portion positioned between the ball striking face and the rear face, the rear face having an opening in communication with a slot positioned in the body;

a weight element positioned in the slot through the opening, wherein the weight element has at least one aperture therethrough to define a removed weight portion that remains void of material; and wherein the aperture has a first horizontal section and a second vertical section, generally transverse to the first horizontal section.

32. An iron type golf club head comprising:

a body having a ball striking face, a rear face opposite the ball striking face and a sole portion positioned between the ball striking face and the rear face rear face having an opening in communication with a slot positioned in the body;

a weight element positioned in the slot through the opening, wherein the weight element has at least one aperture therethrough to define a removed weight portion that remains void of material;

wherein the weight comprises a first and a second weight element; and wherein the body has a dividing wall positioned between the first weight element and the second weight element.

33. The iron type golf club head of claim 32 wherein the first weight element has a first aperture and the second weight element has a second aperture, and wherein the first aperture is sized differently than the second aperture.

34. An iron type golf club head comprising:

a body having a ball striking face, a rear face opposite the ball striking face and a sole portion positioned between the ball face and the rear face, the rear face having an opening in communication with a slot positioned in the body;

a weight element positioned in the slot through the opening, wherein the weight element has at least one aperture therethrough to define a removed weight portion that remains void of material; and wherein the slot comprises a first slot proximate the ball striking face and a second slot proximate the rear face and having an internal wall therebetween, the weight element comprising a first weight element positioned in the first slot and a second weight element positioned in the second slot.

35. An iron golf club comprising:

a golf club head having a body having a ball striking face, a rear face opposite the ball striking face and a sole portion positioned between the ball striking face and the rear face, the rear face having an opening in communication with a slot positioned in the body; a weight element positioned in the slot through the opening;

a shaft member engaged with the golf club head, wherein the weight element has at least one aperture therethrough to define a removed weight portion that remains void of material; and wherein the rear surface further has a bore therethrough and in communication with the slot, and further comprising a fastener positioned in the bore and engaging the weight element to secure the weight element in the slot.

36. The iron type golf club head of claim 35 wherein the weight element is stainless steel.

37. The iron type golf club head of claim 35 wherein the slot is defined between an inner surface of the ball striking face and an inner surface of the rear face.

38. The iron type golf club head of claim 35 wherein the slot extends from the sole portion to proximate a mid portion of the rear face.

39. The iron type golf club head of claim 35 wherein the slot extends from the sole portion to a location under a mid portion of the rear face.

40. The iron type golf club head of claim 35 wherein the weight element extends upwards past the opening.

41. The iron type golf club head of claim 35 wherein the slot extends to proximate a mid portion of the rear face to define a slot opening, the opening in rear face having a lower edge generally coinciding with a first end of the slot, the opening having an upper edge; wherein the weight element has a top edge positioned between the upper edge and the lower edge when the weight element is positioned in the slot.

42. The iron type golf club head of claim 41 wherein the weight element has an aperture wherein the aperture is positioned between the upper edge and the lower edge when the weight element is positioned in the slot.

43. The iron type golf club of claim 35 wherein the fastener forces the weight element against an inner surface of the ball striking face to secure the weight element in the slot, and wherein the force applied to the weight element is generally perpendicular to the inner surface.

44. The iron type golf club head of claim 35 wherein the weight element has a shock absorbent member attached thereto.

45. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element has a first aperture positioned proximate a top edge of the weight element and at a central location of the weight element, wherein the weight element further has a second aperture positioned proximate a bottom edge of the weight element and at a central location of the weight element.

46. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element comprises a first weight element and a second weight element, and wherein the body has a dividing wall positioned between the first weight element and the second weight element.

47. The iron type golf club head of claim 46 wherein the first weight element has a first aperture and the second weight element has a second aperture, and wherein the first aperture is sized differently than the second aperture.

48. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the slot comprises a first slot proximate the ball striking face and a second slot proximate the rear face and having an internal wall therebetween, the weight element comprising a first weight element positioned in the first slot and a second weight element positioned in the second slot.

49. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element has at least one aperture therethrough to define a removed weight portion;

wherein the rear face further has a bore therethrough and in communication with the slot, and further comprising a fastener positioned in the bore and engaging the weight element to secure the weight element in the slot.

50. The iron type golf club of claim 49 wherein the weight element has a bore aligned with the bore of the rear face, the fastener positioned in the bore of the rear face and the bore of the weight element to secure the weight element in the slot.

51. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element has at least one aperture therethrough to define a removed weight portion;

wherein the rear surface further has a bore therethrough and in communication with the slot, and further comprising a fastener positioned in the bore and forcing the weight element against an inner surface of the ball striking face to secure the weight element in the slot.

52. The iron type golf club of claim 51 wherein the force applied to the weight element is generally perpendicular to the inner surface.

53. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element has at least one aperture therethrough to define a removed weight portion;

wherein the weight element has a shock absorbent member attached thereto; and wherein the weight element has a first side edge and a second side edge and a bottom edge, wherein the shock absorbent member is positioned on the first side edge, the second side edge and the bottom edge.

54. The iron type golf club of claim 53 wherein the shock absorbent member is a polymeric material.

55. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element has at least one aperture therethrough to define a removed weight portion;

wherein the aperture has a first horizontal section and a second vertical section, generally transverse to the first horizontal section.

56. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element has at least one aperture therethrough to define a removed weight portion;

wherein the weight element comprises a first weight element and a second weight element; and wherein the body has a dividing wall positioned between the first weight element and the second weight element.

57. The iron type golf club of claim 56 wherein the first weight element has a first aperture and the second weight element has a second aperture, and wherein the first aperture is sized differently than the second aperture.

58. An iron type golf club head comprising:

a body having a ball striking face, a rear face opposite the ball striking face and a sole portion positioned between the ball striking face and the rear face, the rear face having an opening in communication with a slot positioned in the body; and a weight element positioned in the slot through the opening, wherein the weight element has at least one aperture therethrough to define a removed weight portion;

wherein the slot comprises a first slot proximate the ball striking face and a second slot proximate the rear face and having an internal wall therebetween, the weight element comprising a first weight element positioned in the first slot and a second weight element positioned in the second slot.

59. An iron golf club comprising:

a golf club head having a body having a ball striking face, a rear face opposite the ball striking face and a sole portion positioned between the ball striking face and the rear face, the rear face having an opening in communication with a slot positioned in the body; a weight element positioned in the slot through the opening; and a shaft member engaged with the golf club head, wherein the weight element has at least one aperture therethrough to define a removed weight portion;

wherein the rear surface further has a bore therethrough and in communication with the slot, and further comprising a fastener positioned in the bore and engaging the weight element to secure the weight element in the slot.

60. The iron type golf club of claim 59 wherein the fastener forces the weight element against an inner surface of the ball striking face to secure the weight element in the slot, and wherein the force applied to the weight element is generally perpendicular to the inner surface.

* * * * *